US006392540B1

(12) United States Patent
Brown

(10) Patent No.: US 6,392,540 B1
(45) Date of Patent: May 21, 2002

(54) NON-AUDITORY SOUND DETECTION SYSTEM

(76) Inventor: Mary E. Brown, 128 Ellicott St., Rochester, NY (US) 14619

( * ) Notice: Subject to any disclaimer, the term of this patent is extended or adjusted under 35 U.S.C. 154(b) by 0 days.

(21) Appl. No.: 09/564,732

(22) Filed: May 4, 2000

(51) Int. Cl.[7] ..... G08B 21/00
(52) U.S. Cl. ..... 340/540; 340/407.1
(58) Field of Search ..... 340/540, 531, 340/539, 825.19, 407.1, 965; 434/112, 114

(56) References Cited

U.S. PATENT DOCUMENTS

| | | | | | |
|---|---|---|---|---|---|
| 2,582,277 | A | | 1/1952 | Powlison | |
| 4,237,449 | A | * | 12/1980 | Zibell | 340/407.1 |
| 4,581,491 | A | | 4/1986 | Boothroyd | |
| 4,728,934 | A | | 3/1988 | Pfander et al. | |
| 4,777,474 | A | * | 10/1988 | Clayton | 340/407.1 |
| 4,791,620 | A | | 12/1988 | Leysieffer et al. | |
| 4,801,921 | A | * | 1/1989 | Zigenfus | 340/573.1 |
| 5,035,242 | A | | 7/1991 | Franklin et al. | |
| D319,031 | S | | 8/1991 | Levinson | |
| 5,353,017 | A | * | 10/1994 | Suzuki et al. | 340/407.1 |
| 5,651,070 | A | * | 7/1997 | Blunt | 340/407.1 |
| 5,686,882 | A | * | 11/1997 | Giani | 340/407.1 |

* cited by examiner

*Primary Examiner*—John A. Tweel

(57) ABSTRACT

A non-auditory sound detection system for changing sound into non-auditory signals that stimulate a user to alert the user of the presence of a pre-determined sound. The non-auditory sound detection system includes a non-auditory system for detecting and alerting a person to the presence of a predetermined sound. The system includes a main control unit and a transceiver for receiving a predetermined sound. The transceiver is utilized for transmitting an activation signal upon receiving the predetermined sound. A remote assembly includes an attachment device. The attachment device is designed for coupling to a human. The communication device is coupled to the attachment device and the communication device is also electrically coupled to the receiver for providing a non-auditory signal to the human is upon reception of the pre-determined sound by the receiver.

1 Claim, 2 Drawing Sheets

NON-AUDITORY SOUND DETECTION SYSTEM

BACKGROUND OF THE INVENTION

1. Field of the Invention

The present invention relates to non-auditory detection systems and more particularly pertains to a new non-auditory sound detection system for changing sound into non-auditory signals that stimulate a user to alert the user of the presence or a pre-determined sound.

2. Description of the Prior Art

The use of non-auditory systems is known in the prior art. More specifically, non-auditory system heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,827,934; U.S. Pat. No. 5,035,242; U.S. Pat. No. 2,582,277; U.S. Pat. No. 4,581,491; U.S. Pat. No. 4,791,620; and U.S. Pat. No. Des. 319,031.

While these devices fulfill their respective, particular objectives and requirements, the aforementioned patents do not disclose a new non-auditory sound detection system. The inventive device includes a non-auditory system for detecting and alerting a person to the presence of a predetermined sound. The system includes a main control unit and a transceiver for receiving a predetermined sound. The transceiver is utilized for transmitting an activation signal upon receiving the predetermined sound. A remote assembly includes an attachment device. The attachment device is designed for coupling to a human and the receiver is coupled to the attachment device.

The communication device is coupled to the attachment device, the communication device is also electrically coupled to the receiver for providing a non-auditory signal to the human upon reception of the pre-determined sound by the receiver.

In these respects, the non-auditory sound detection system according to the present invention substantially departs from the conventional concepts and designs of the prior art, and in so doing provides an apparatus primarily developed for the purpose of changing sound into non-auditory signals that stimulate a user to alert the user of the presence of a pre-determined sound.

SUMMARY OF THE INVENTION

In view of the foregoing disadvantages inherent in the known types of non-auditory system now present in the prior art, the present invention provides a non-auditory sound detection system construction wherein the same can be utilized for changing sound into non-auditory signals that stimulate a user to alert the user of the presence of a pre-determined sound.

The general purpose of the present invention, which will be described subsequently in greater detail, is to provide a new non-auditory sound detection system apparatus and method which has many of the advantages of the non-auditory system mentioned heretofore and many novel features that result in a new non-auditory sound detection system which is not anticipated, rendered obvious, suggested, or even implied by any of the prior art non-auditory system, either alone or in any combination thereof.

To attain this, the present invention generally includes a non-auditory system for detecting and alerting a person to the presence of a predetermined sound. The system includes a main control unit and a transceiver for receiving a predetermined sound. The transceiver is utilized for transmitting an activation signal upon receiving the predetermined sound. A remote assembly includes an attachment device. The attachment device is designed for coupling to a human and the receiver is coupled to the attachment device. The communication device is coupled to the attachment device, the communication device is also electrically coupled to the receiver for providing a non-auditory signal to the human upon reception of the pre-determined sound by the receiver.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new non-auditory sound detection system apparatus and method which has many of the advantages of the non-auditory system mentioned heretofore and many novel features that result in a new non-auditory sound detection system which is not anticipated, rendered obvious, suggested, or even implied by any of the prior art non-auditory system, either alone or in any combination thereof.

It is another object of the present invention to provide a new non-auditory sound detection system which may be easily and efficiently manufactured and marketed.

It is a further object of the present invention to provide a new non-auditory sound detection system which is of a durable and reliable construction.

An even further object of the present invention is to provide a new non-auditory sound detection system which is susceptible of a low cost of manufacture with regard to both materials and labor, and which accordingly is then susceptible of low prices of sale to the consuming public, thereby making such non-auditory sound detection system economically available to the buying public.

Still yet another object of the present invention is to provide a new non-auditory sound detection system which provides in the apparatuses and methods of the prior art some of the advantages thereof, while simultaneously overcoming some of the disadvantages normally associated therewith.

Still another object of the present invention is to provide a new non-auditory sound detection system for changing sound into non-auditory signals that stimulate a user to alert the user of the presence of a pre-determined sound.

Yet another object of the present invention is to provide a new non-auditory sound detection system which includes a non-auditory system for detecting and alerting a person to the presence of a predetermined sound. The system includes a main control unit and a transceiver for receiving a predetermined sound. The transceiver is utilized for transmitting an activation signal upon receiving the predetermined sound. A remote assembly includes an attachment device. The attachment device is designed for coupling to a human and the receiver is coupled to the attachment device. The communication device is coupled to the attachment device, the communication device is also electrically coupled to the receiver for providing a non-auditory signal to the human is upon reception of the pre-determined sound by the receiver.

Still yet another object of the present invention is to provide a new non-auditory sound detection system that will enable a hearing impaired human to experience certain environmental sounds that the user would otherwise not experience.

Even still another object of the present invention is to provide a new non-auditory sound detection system that would enable a user to more effectively participate in playing or listening to music and learning how to dance.

These together with other objects of the invention along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
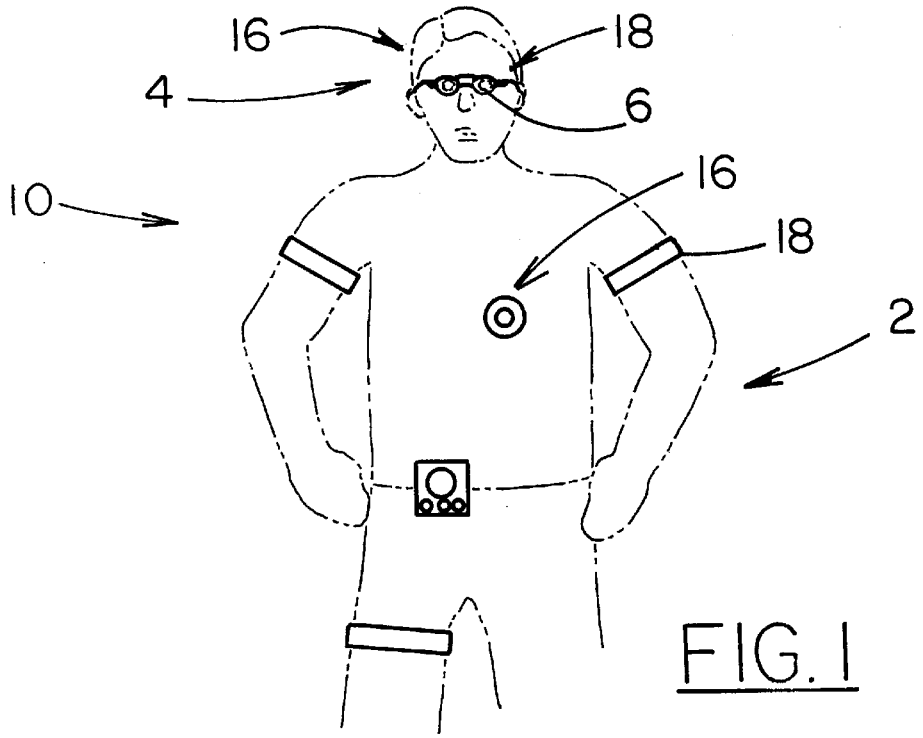
FIG. 1 is a front perspective view of a new non-auditory sound detection system according to the present invention.
Figure 2:
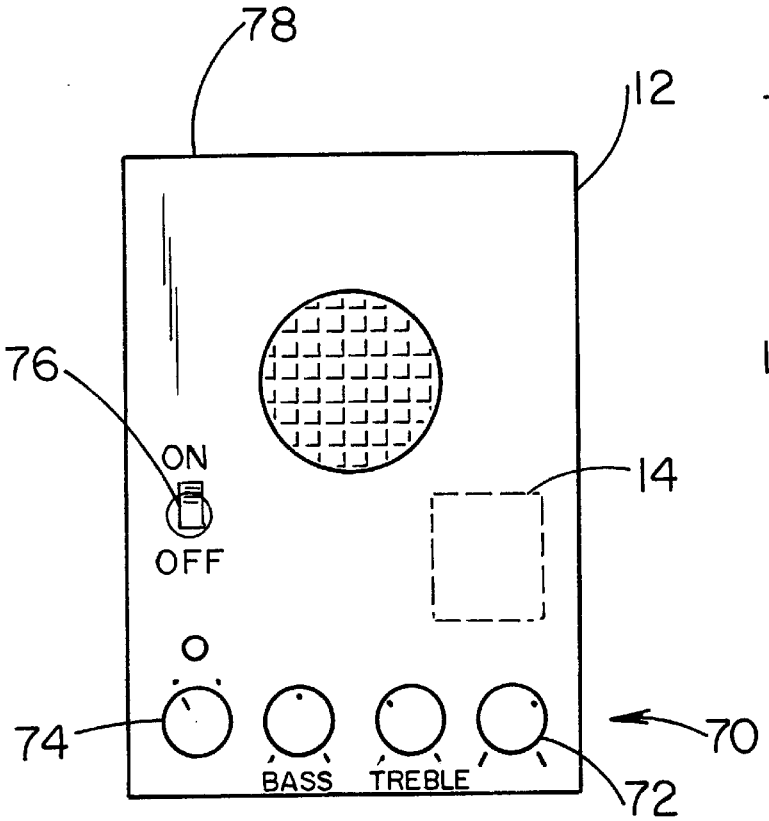
FIG. 2 is a front view of the sound receiver of the present invention.
Figure 3:
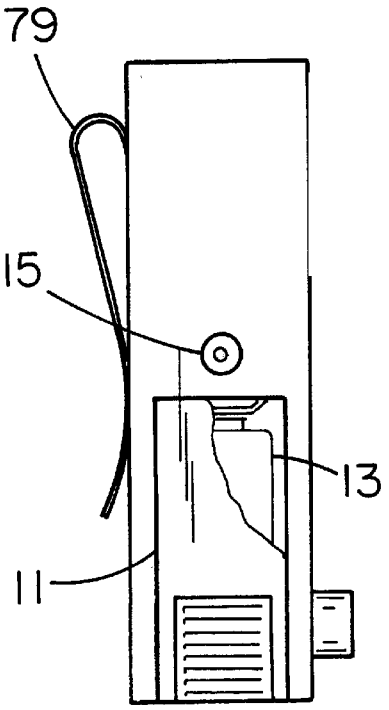
FIG. 3 is a side view of the sound receiver of the present invention.
Figure 4:
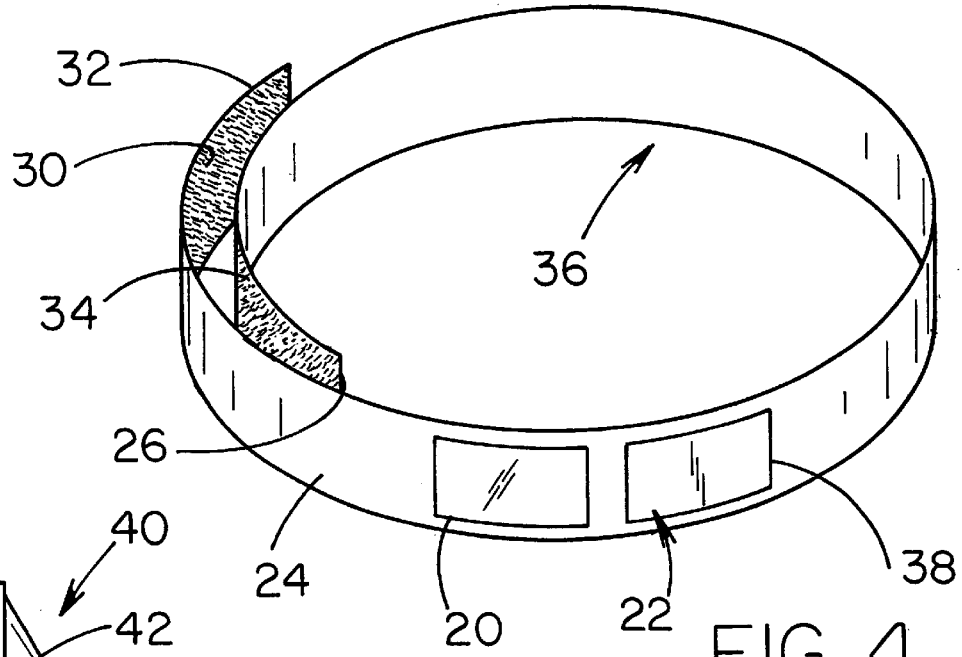
FIG. 4 is a perspective view of the attachment band of the present invention.
Figure 5:
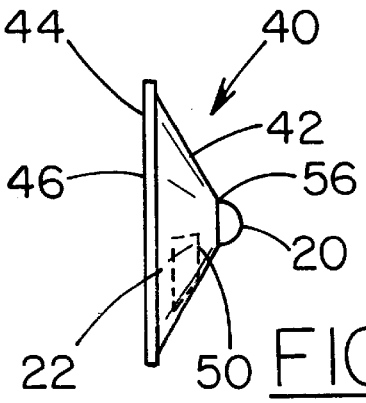
FIG. 5 is a side view of the vibrator of the present invention.
Figure 6:
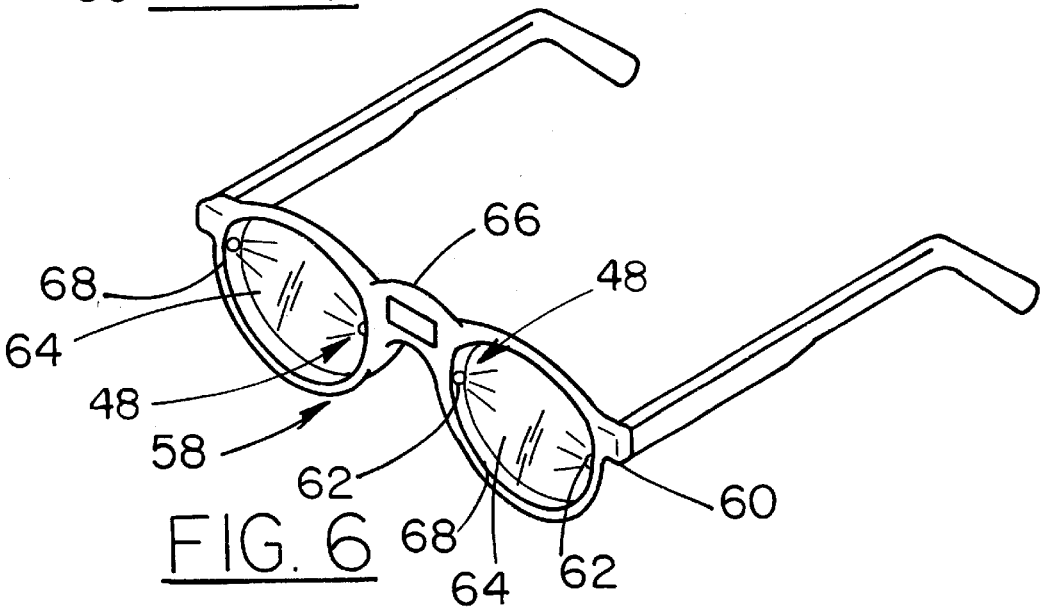
FIG. 6 is a perspective view of the glasses of the present

With reference now to the drawings, and in particular to FIGS. 1 through 6 thereof, a new non-auditory sound detection system embodying the principles and concepts of the present invention and generally designated by the reference numeral 10 will be described.

As best illustrated in FIGS. 1 through 6, the non-auditory sound detection system 10 generally includes a non-auditory system for detecting and alerting a person to the presence of a predetermined sound. A main control unit 12 includes a transceiver 14 for receiving a plurality of predetermined sounds which also transmits one of a plurality of activation signals upon receiving one of the pluralities of the predetermined sounds. The activation signal is associated with a respective one of the predetermined sounds.

A plurality of remote assemblies 16, each includes an associated attachment device 18. The attachment device 18 is designed for coupling to a human being 2. Each remote assembly 16 includes an associated receiver 20 coupled to the associated attachment device 18. Each remote assembly 16 includes an associated non-audio sensory communication device 22. The associated communication device 22 is coupled to the associated attachment device 18. The associated communication device 22 further is electronically coupled to the associated receiver 20 for providing a non-auditory signal to the human 2 upon reception of an associated one of the activation signals by the associated receiver 20.

The associated attachment device 18 of a first one of the remote assemblies 16 is a band 24, opposite ends of the band 24 is engageable to each other whereby the band 4 is designed for coupling to a part of the human being 2. The first one of the opposite ends 26 of the band 24 includes a portion of a hook and loop fastener 30, a second one of the opposite ends 32 of the band 24 includes a complimentary portion 34 of a hook and loop fastener 30 whereby the first one of the opposite ends 26 is couplable to the second one of the opposite ends 32

The associated communication device of the first remote assembly 36 is a band vibrator 38. The band vibrator 38 is coupled to the band 24 such that the band vibrator 38 is positioned to abut a portion of the human 2 is such that the band vibrator 38 provides a vibrator signal upon receipt of a first one of the associated activation signals by the receiver 20 associated with the first remote assembly 36.

The attachment device 18 of a second one of the remote assemblies 40 is a housing 42 that includes a substantially planar face 44, the planar face 44 is covered by all adhesive 46 for selectively engaging the planar face 44 to the human being 2. The associated communication device 22 of the second remote assembly 40 is a housing vibrator 50. The housing vibrator 50 is coupled to the housing 42 within an interior of the housing 42 such that the housing vibrator 50 is positioned to abut a portion of the housing 42 such that the housing vibrator 50 vibrates the housing 42 upon receipt of a second one of the associated activation signals by the receiver 20 associated with the second remote assembly 40 whereby the human being 2 is alerted to a second one of the predetermined sounds, the second predetermined sound is associated with the second remote assembly 40.

The housing 42 is generally cone shaped, the receiver 20 associated with the second remote assembly 40 is positioned at an apex 56 of the housing 42 for positioning the receiver 20 associated with the second remote assembly 40 distally from the planar surface 44 for facilitating reception of the second one of the activation signals by the receiver 20 associated with the second remote assembly 40.

The attachment device 18 of a third remote assembly 58 is a pair of glasses 60 designed for positioning on a human head 4.

The communication device 48 associated with the third remote assembly 58 is at least one light 62 coupled to the pair of glasses 60 such that the light 62 is visible to a wearer of the pair of glasses 60 When the pair of glasses 60 is worn and the light 62 is illuminated, the light 62 is illuminatable upon reception of a third one of the activation signals, the third activation signal is associated with the third remote assembly 58 whereby the wearer is alerted to the third predetermined sound by the light 62. The pair of glasses 60 includes a pair of openings 64 for positioning adjacent to a pair of eyes 6 of the wearer, the pair of glasses 60 further includes a bridge 66 extending between the openings 64.

The receiver 20 associated with the third remote assembly 58 is positioned on the bridge 66 of the pair of glasses 60. The communication device 48 associated with the third remote assembly 58 further is two pairs of lights 62, each pair is coupled to a perimeter edge 68 of an associated one of the pair of openings 64.

The main control unit 12 includes a plurality of controls 70, the plurality of controls 70 including at least one sound adjustment control 72 for adjusting the predetermined sound. The plurality of controls 70 including an on/off control 76 for activating the main control unit 12. The plurality of controls 70 including a sensitivity control 74 for adjusting a volume level of the predetermined sound required for triggering transmission of the activation signal. The main control unit 12 includes a main unit housing 78. A clip 79 coupled to the main unit housing 78 for facilitating attachment of the main control unit 12 to the human being. The housing 78 including a battery compartment 11 for holding at least one battery 13 for powering the main control unit 12. The main unit housing 78 including a battery recharge port 15 for recharging the battery 13.

In use, a user places the sound receiver on his waist and attaches various sensors about their body. When the receiver detects certain sounds the corresponding sensor is activated.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing, is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A non-auditory system for detecting and alerting a person to the presence of a predetermined sound, the system comprising:

a main control unit having a transceiver for receiving a plurality of predetermined sounds, said transceiver further being for transmitting one of a plurality of activation signals upon receiving one of said plurality of said predetermined sounds, each activation signal being associated with a respective one of said predetermined sounds;

a plurality of remote assemblies, each having an associated attachment device, said attachment device being adapted for coupling to a human being;

each remote assembly having an associated receiver coupled to said associated attachment device;

each remote assembly having an associated non-audio sensory communication device, said associated communication device being coupled to said associated attachment device, said associated communication device further being operationally coupled to said associated receiver for providing a non-auditory signal to the human being upon reception of an associated one of said activation signals by said associated receiver;

said associated attachment device of a first one of said remote assemblies being a band, opposite ends of said band being engageable to each other whereby said band is adapted for coupling to a part of the human being;

a first one of said opposite ends of said band having a portion of a hook and loop fastener, a second one of said opposite ends of said band having a complimentary portion of a hook and loop fastener whereby said first one of said opposite ends is couplable to said second one of said opposite ends;

said associated communication device of said first remote assembly being a band vibrator, said band vibrator being coupled to said band such that said band vibrator is positioned to abut a portion of the human being such that said band vibrator provides a vibratory signal upon receipt of a first one of said associated activation signals by said receiver associated with said first remote assembly;

said attachment device of a second one of said remote assemblies being a housing having a substantially planar face, said planar face being covered by an adhesive for selectively engaging said planar face to the human being;

said associated communication device of said second remote assembly being a housing vibrator;

said housing vibrator being coupled to said housing within an interior of said housing such that said housing vibrator is positioned to abut a portion of said housing such that said housing vibrator vibrates said housing upon receipt of a second one of said associated activation signals by said receiver associated with said second remote assembly whereby the human being is alerted to a second one of said predetermined sounds, said second predetermined sound being associated with said second remote assembly;

said housing being generally cone shaped, said receiver associated with said second remote assembly being positioned at an apex of said housing for positioning said receiver associated with said second remote assembly distally from said planar surface for facilitating reception of said second one of said activation signals by said receiver associated with said second remote assembly;

said attachment device of a third remote assembly being a pair of glasses adapted for positioning on a human head;

said communication device associated with said third remote assembly being at least one light coupled to said pair of glasses such that said light is visible to a wearer of the pair of glasses when said pair of glasses is worn and said light is illuminated, said light being illuminatable upon reception of a third one of said activation signals, said third activation signal being associated with said third remote assembly whereby the wearer is alerted to the third predetermined sound by said light;

said pair of glasses having a pair of openings for positioning adjacent to a pair of eyes of the wearer, said pair of glasses further having a bridge extending between said openings;

said receiver associated with said third remote assembly being positioned on said bridge of said pair of glasses;

said communication device associated with said third remote assembly further being two pairs of lights, each pair being coupled to a perimeter edge of an associated one of said pair of openings;

said main control unit having a plurality of controls, said plurality of controls including at least one sound adjustment control for adjusting said predetermined sound;

said plurality of controls including an on/off control for activating said main control unit;

said plurality of controls including a sensitivity control for adjusting a volume level of said predetermined sound required for triggering transmission of said activation signal;

said main control unit including a main unit housing;

a clip coupled to said main unit housing for facilitating attachment of said main control unit to the human being;

said housing including a battery compartment for holding at least one battery for powering said main control unit; and said main unit housing including a battery recharge port for recharging said battery.

* * * * *